US005176337A

United States Patent [19]

Lee

[11] Patent Number: 5,176,337

[45] Date of Patent: Jan. 5, 1993

[54] MISSILE TRACKING ACTIVATION CIRCUIT

[75] Inventor: Gary Lee, Costa Mesa, Calif.

[73] Assignee: Loral Aerospace Corp., New York, N.Y.

[21] Appl. No.: 524,968

[22] Filed: Aug. 22, 1983

[51] Int. Cl.[5] ..... F41G 7/22

[52] U.S. Cl. ..... 244/3.15

[58] Field of Search ..... 244/3.1, 3.15, 3.16, 244/3.19, 3.2

[56] References Cited

U.S. PATENT DOCUMENTS 3,333,789 8/1967 Schreiner, Jr. ..... 244/3.15

3,798,420 3/1974 Kaaz ..... 235/61.5 S

*Primary Examiner*—Charles T. Jordan

*Attorney, Agent, or Firm*—Edward J. Radlo

[57] ABSTRACT

An electronic activation circuit (1) for automatically transitioning a guided missile from a non-tracking mode to a tracking mode. When the missile's tracking means comprises a gyroscope, the non-tracking mode corresponds to the gyroscope being caged. A parameter indicating target signal quality is extracted (2) from a missile carrier signal (3) generated by means, which may be on board the missile or associated with the device launching the missile, for measuring target signal quality. This signal (3) is compared (6) against a preselected reference threshold voltage (4) to determine whether the tracking mode is to be initiated. Temporary indications to recage during a preselected time delay latch period T are suppressed (8, 10). The quality threshold comparison (6) is hysteresis conditioned (46, 48, 50, 52) to attenuate the effects of noise on the input signal (3). A switch (16) allows the operator to preinitialize the tracking activation circuit (1) prior to the time when the target signal (3) is of sufficient quality to permit tracking, i.e., prior to combat. When the missile leaves its launch rail, an umbilical electrical connection (13, 15) between the missile and rail is severed, preventing the gyroscope from being recaged, by the operator or otherwise, subsequent to missile launch.

6 Claims, 3 Drawing Sheets

FIG. 1

MISSILE TRACKING ACTIVATION CIRCUIT

TECHNICAL FIELD

This invention pertains to the field of automatically activating the tracking circuit of a guided missile.

BACKGROUND ART

U.S. Pat. No. 3,333,789 discloses a technique for controlling missile dynamics depending upon whether a predetermined error threshold has been exceeded. It is not a technique for activating the tracking mode of a missile as in the present invention.

U.S. Pat. No. 3,798,420 is a technique for calculating angular velocities to enable the automatic tracking of a motor driven device, such as a gun sight, onto a moving target. It is not a circuit for transitioning between the non-tracking mode and the tracking mode of a missile as in the present invention. Rather, this patent operates solely within the tracking mode; it provides calculations used for a transition between manual tracking and automatic tracking.

This invention finds its applicability in guided missiles adapted to track a target, wherein the missile system includes means, which may be situated on board the missile or on board the object (e.g., airplane) launching the missile, for determining whether the target is or is not of sufficient "quality" to enable the missile's onboard tracking means to satisfactorily track the target. The "quality" measured may be the amplitude of an electromagnetic signal emanating or reflecting from the target combined with noise associated with the target's background. In prior art systems, this target quality measuring means produces some indication, such as an audible tone in the headset of the operator responsible for launching the missile, when adequate tracking quality has been achieved. In response to this signal, the operator manually activates a switch to place the missile into the tracking mode. The problem with this approach is that the operator's reaction time becomes a factor in target acquisition, and furthermore, especially in the case where the operator is a pilot flying solo in an aircraft, such manual activation is potentially dangerous because the pilot may be engaged in urgent maneuvers to avoid enemy fire, demanding his full attention. What is needed, therefore, is an automatic system for activating the tracking mode of the missile, wherein the system compensates for noise-induced jitter, has memory, and prevents reversion to the non-tracking mode at inopportune moments. These goals are accomplished by activation circuit 1 of the present invention.

DISCLOSURE OF INVENTION

The present invention is an electronic activation circuit (1) which automatically commands the tracking means of a guided missile when to leave a non-tracking mode of operation, in which the missile is not tracking its target, and to enter a tracking mode, in which the missile is tracking its target. In the case where the missile's tracking means includes a gyroscope, the non-tracking mode corresponds to the gyroscope being caged (restrained) within the missile, while the tracking mode corresponds to the gyroscope being uncaged.

Provided as an input to the activation circuit (1) is a missile carrier signal (3) which contains information as to whether or not the quality of the target is sufficient to permit tracking by the tracking means. The missile carrier signal (3) is demodulated by an amplitude detector (2), and is compared (at 6) with a predetermined reference voltage (4) representing an empirically based target quality threshold. The comparator (6) is hysteresis conditioned to minimize the effects of jitter induced by noise on the missile carrier signal (3).

Time delay means (8, 10) provides a preselected time latch (T) during which an initial command to activate the tracking means is continued despite a momentary loss in target quality as signaled by the missile carrier signal (3).

An umbilical electrical connection (13, 15) connecting the missile with its launch rail is severed when the missile is launched. This disables the comparing (6) and delaying (8, 10) portion of the activation circuit (1), thus preventing reversion to the non-tracking mode regardless of the presence of any post-launch indication from the missile carrier signal (3) that the target quality is not adequate.

The activation circuit (1) further comprises a switch (16) by which the operator of the missile, e.g., an aircraft pilot in the case of an air-to-air missile, can pre-initialize or disable the activation circuit (1). The output of this switch (16) is coupled to the missile via an umbilical electrical connection line (15), which, upon being severed during missile launch, prevents the operator from subsequently returning the missile to the non-tracking mode.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

The invention will be described with respect to that class of missiles, such as Sidewinder missiles, in which the missile's onboard tracking means includes a spinning gyroscope mounted within the nose of the missile. The gyroscope may be pivotally mounted using gimbals about two orthogonal axes (called the "right/left" and "up/down" axes) which are each orthogonal to the longitudinal axis of the missile. The gyroscope is said to be "caged" when the gimbals are locked so that the gyroscope's spin axis is constrained to lie along the longitudinal axis of the missile. The gyroscope is said to be "uncaged" when the gimbals are unlocked to provide partial, e.g., 60°, rotation about each of the right-/left and up/down axes. The gyroscope is caged whenever the missile is in the non-tracking mode, the missile is in the non-tracking mode whenever the gyroscope is caged, the gyroscope is uncaged whenever the missile is in the tracking mode, and the missile is in the tracking mode whenever the gyroscope is uncaged.

This invention has direct applicability to the more general case where the missile's tracking means does not include a gyroscope.

Figure 1:
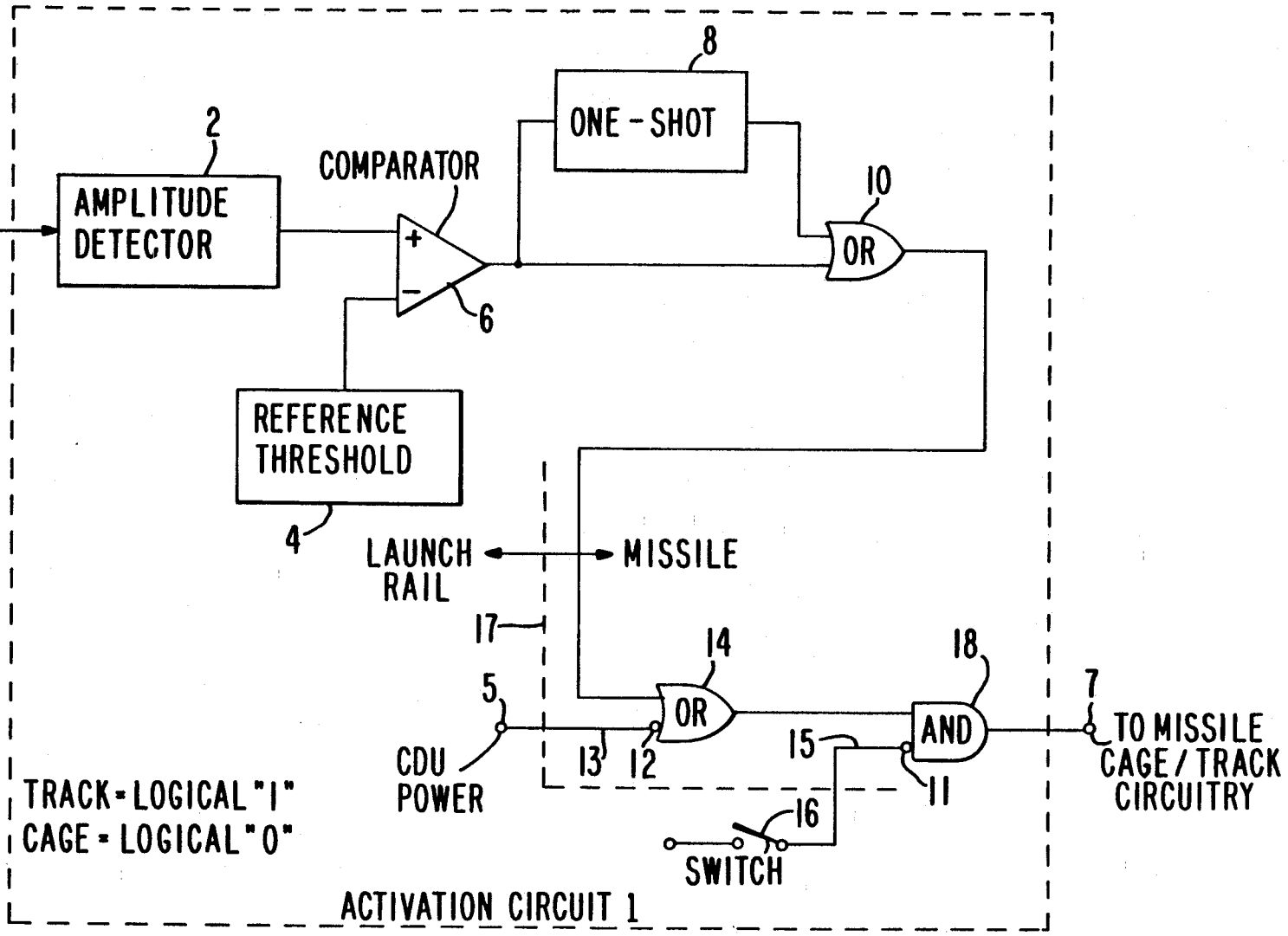
FIG. 1 is a logical block diagram of activation circuit 1 of the present invention.

Turning to FIG. 1, the output of the target quality measuring means is denominated missile carrier signal 3. Signal 3 can assume many forms, but it is assumed for the purposes of this discussion that signal 3 is a sine wave whose voltage amplitude is proportional to the voltage of the signal emanating or reflecting from the target plus the voltage of the noise due to the background. Such a signal 3 may be produced, e.g., by a reticle mounted with the spinning gyroscope, after smoothing and filtering. In this case, the frequency of the sine wave is equal to the spin frequency of the gyroscope times the number of partitions in the reticle. The signal plus noise voltage of signal 3 is typically on the order of 0.8 volts, while the random noise corrupting the signal 3 is on the order of 0.5 volts.

The amplitude of signal 3 is extracted by amplitude detector 2, which can be a rectifier and filter. The output of detector 2 is a smoothed direct current voltage representing the signal plus noise. This is compared by comparator 6 with a reference threshold voltage 4, which has been preselected based upon experiential data. Threshold voltage 4 is set, depending upon mission requirements, to be greater than the average amplitude of the noise, but less than the amplitude of the signal plus noise corresponding to targets of unassailable tracking quality. It is normally desired for voltage 4 to be as close as possible to the noise level so that the tracking of the target can commence as soon as possible, yet not so close to the noise level that the quality of the tracking will be unreliable. In FIG. 1, a logical 1 signal at the output of comparator 6 indicates that the tracking mode is to be activated, while a logical 0 output indicates that the gyroscope is to be caged.

The output of comparator 6 is fed via one-shot 8 to a first input of OR-gate 10, and directly as a second input of OR-gate 10. Together, one-shot 8 and OR-gate 10 comprise a time latch having a preselected time delay T during which the gyroscope will not be recaged despite a momentary indication from signal 3 that the target is not of adequate tracking quality. This is because one-shot 8 produces a pulse having a logical 1 value for time T, which keeps the output of OR-gate 10 a logical 1 despite the output of comparator 6 being a logical 0. Time T is selected based upon mission requirements and is 250 milliseconds in the case of the FIG. 2 embodiment. As a consequence of this time-latch feature, a temporary loss in target signal quality, such as may be occasioned by the temporary interposition of a cloud or smoke between the missile and the target, will not deactivate the tracking mode.

The output from OR-gate 10 is fed as a first input to OR-gate 14. A power supply voltage 5, typically plus 28 volts for the cooled detector unit (CDU) of the missile, is connected via a first line 13 of an umbilical electrical connection between the missile's launch rail and the missile, thence via inverter 12 to a second input of OR-gate 14. The purpose of this circuitry is to satisfy the mission requirement that the gyroscope cannot be caged after the missile leaves its launch rail. This is because the line 13 coupling the power supply 5 and that portion of activation circuit 1 situated on board the missile is severed when the missile leaves its launch rail. This forces the second input of OR-gate 14 to be a logical 1, which forces the output of OR-gate 14 to be a logical 1 regardless of the status of its first input.

The output of OR-gate 14 is fed as a first input to AND-gate 18. The output of AND-gate 18 is fed at terminal 7 to the caging and tracking means on board the missile. A manual switch 16 is situated on the launch rail side of the launch rail/missile interface 17, i.e., on the airplane or other object from which the missile is launched, and is connected via a second line 15 of the umbilical electrical connection 13, 15 and via inverter 11 to a second input of AND gate 18. The purpose of this arrangement is to allow the operator to disable activation circuit 1 by closing switch 16, and to preinitialize activation circuit 1 before entering combat by opening switch 16. When the missile leaves its launch rail, line 15 is severed, forcing switch 16 into a permanent open position, forcing the second input of AND-gate 18 to be a logical 1, thus preventing the operator from disabling the tracking mode subsequent to launch even if he closes switch 16.

Thus, in satisfaction of mission requirements, the gyroscope cannot be accidentally or intentionally caged subsequent to launch, thanks to the circuitry associated with gates 14 and 18.

Figure 2:
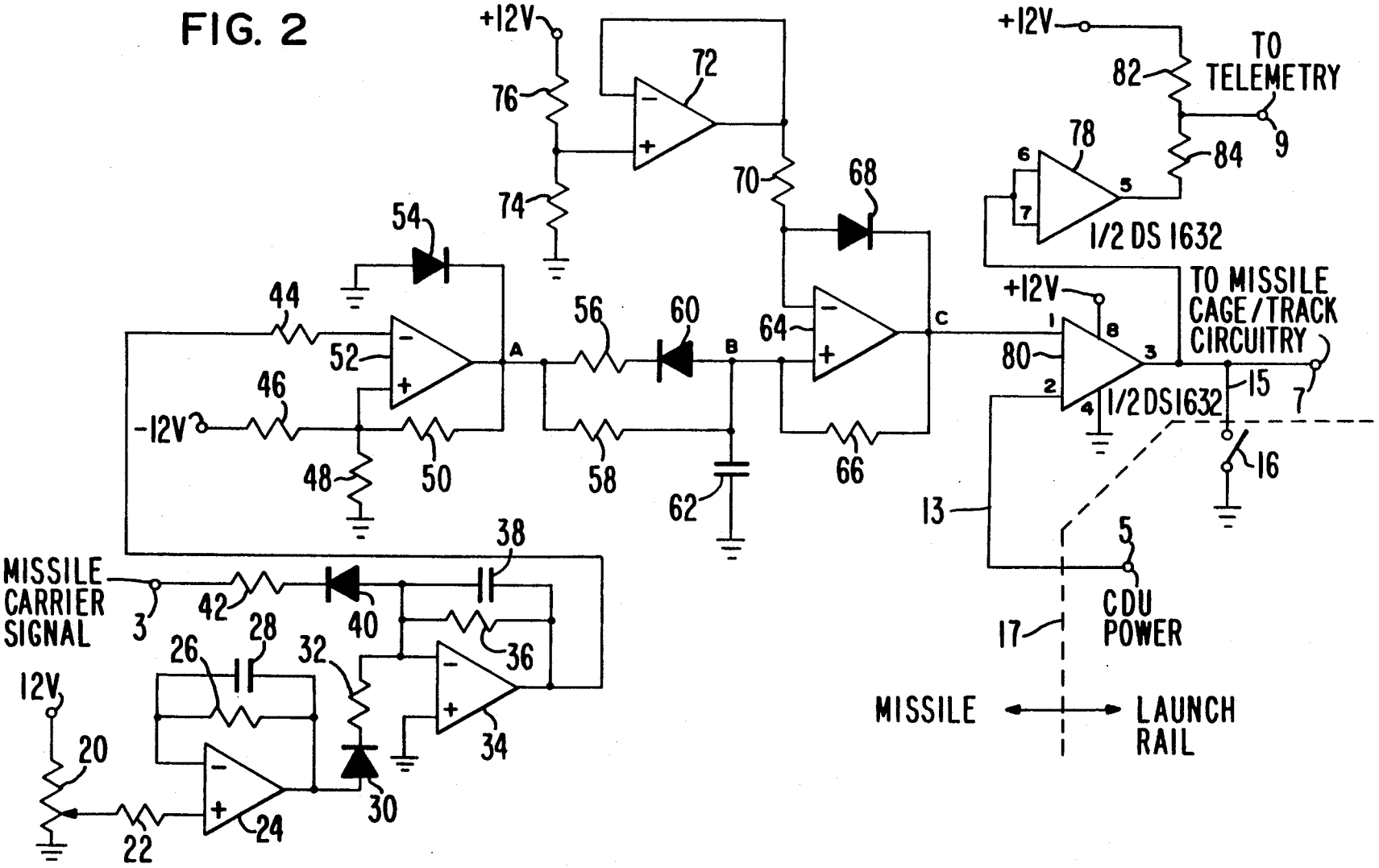
FIG. 2 is a detailed circuit diagram of a preferred embodiment of activation circuit 1 of the present invention.

Turning now to FIG. 2, comparator 24, typically a 741 op amp, has its noninverting input terminal connected via resistor 22, typically a 500K ohm resistor, to potentiometer 20, typically a 50K ohm 10-turn pot. One end of resistor 20 is connected to ground and the other end is connected to the d.c. power supply voltage, which in the case of the CMOS circuitry described herein, is plus 12 volts.

The inverting input terminal of op amp 24 is connected via a parallel RC network to the output of op amp 24. This parallel RC network comprises resistor 26, which in the illustrated embodiment is a 500K ohm resistor, and capacitor 28, a 1000pf capacitor. The output of op amp 24 is connected via diode 30, which may be a 1N914 diode, and via resistor 32, e.g., a 100K ohm resistor, to the inverting terminal of comparator 34, e.g., a 741 op amp. The non-inverting input terminal of op amp 34 is connected to ground. The inverting input terminal of op amp 34 is also connected via diode 40, the same type as but oppositely biased from diode 30, and resistor 42, e.g., a 37.4K ohm resistor, to the input terminal conveying missile carrier signal 3. The inverting input terminal and the output terminal of op amp 34 are connected via a parallel RC circuit comprising 100K ohm resistor 36 and 0.47 microfarad capacitor 38.

The output terminal of op amp 34 is connected via resistor 44, e.g., a 10K ohm resistor, to the inverting input terminal of comparator 52, e.g., a 741 op amp. The non-inverting input terminal of op amp 52 is connected via resistor 46, e.g., a 7.5K ohm resistor, to the negative voltage side of the d.c. power supply, i.e., −12 volts; via resistor 48, e.g., a 100K ohm resistor, to ground; and via resistor 50, e.g., a 120K ohm resistor, to the output terminal of op amp 52. The output terminal of op amp 52 is also connected via diode 54, e.g., a 1N914 diode, to ground; through resistor 58, e.g., a 480K ohm resistor, and capacitor 62, e.g., a 0.47 microfarad poly capacitor, to ground; and via resistor 56, e.g., a 5K ohm resistor, and diode 60, e.g., a 1N914 diode, to the non-inverting input terminal of comparator 64, e.g., a 156 op amp. The end of capacitor 62 not connected to ground is also connected to the non-inverting input terminal of op amp 64.

The non-inverting input terminal and the output terminal of op amp 64 are connected via resistor 66, e.g., a 10 megohm resistor. The output terminal of op amp 64 is connected via diode 68, e.g., a 1-N914 diode, to the inverting input terminal of op amp 64. The inverting input terminal of op amp 64 is also connected via resistor 70, e.g., a 10K ohm resistor, to the output terminal and to the inverting input terminal of comparator 72, e.g., a 741 op amp. The non-inverting input terminal of op amp 72 is connected via resistor 74, e.g., a 10K ohm resistor, to ground; and via resistor 76, e.g., a 5K ohm resistor, to the +12 volt d.c. power supply.

The output terminal of op amp 64 is also connected to pin 1 of device 80, which is one half of a DS 1632 integrated circuit. Pin 2 of device 80 is connected via umbilical line 13 across the missile/launch rail interface 17 to the CDU power supply terminal 5. Pin 4 of device 80 is grounded. Pin 8 of device 80 is connected to the +12 volt d.c. power supply. Pin 3 of device 80 is connected to output terminal 7, which couples to the caging and tracking means of the missile; and to pins 6 and 7 of device 78, which is the second half of integrated circuit DS 1632.

The operator's manual switch 16 is situated on the launch rail side of the missile/launch rail interface 17, has one terminal connected to ground, and has its other terminal connected via umbilical line 15 across interface 17 to output terminal 7.

Output pin 5 of device 78 is connected via resistor 84, e.g., a 4.99K ohm resistor, to terminal 9, which provides an output to telemetry circuitry on board the missile. Terminal 9 is also connected via resistor 82, having the same resistance as resistor 84, to the +12 volt d.c. power supply.

Op amp 24, resistor 26 and capacitor 28 comprise a voltage regulator circuit to regulate the reference threshold voltage 4 established by resistors 20 and 22. Resistors 42 and 32 are gain equalizing resistors. Diode 40 corresponds to amplitude detector 2 of FIG. 1. Diode 30 is biased oppositely to diode 40 and temperature compensates diode 40. Capacitor 38 and resistor 36 comprise a ripple filter for smoothing the rectified input signal 3.

Op amps 34 and 52, resistors 44, 46, 48 and 50, and diode 54 are the equivalent of comparator 6. Resistor 44 balances offset voltages of op amp 52. Diode 54 is a clamping diode, set for the illustrated embodiment at 0.7 volts. A logical zero at the output of op amp 52 is thus represented by −0.7 volts, while a logical 1 at the output of op amp 52 is represented by +12 volts.

Up to point C in circuit 1, negative logic (compared with that shown in FIG. 1) is employed; thus, at points A, B, and C a logical 1 indicates caging while a logical 0 indicates tracking.

Figure 3:
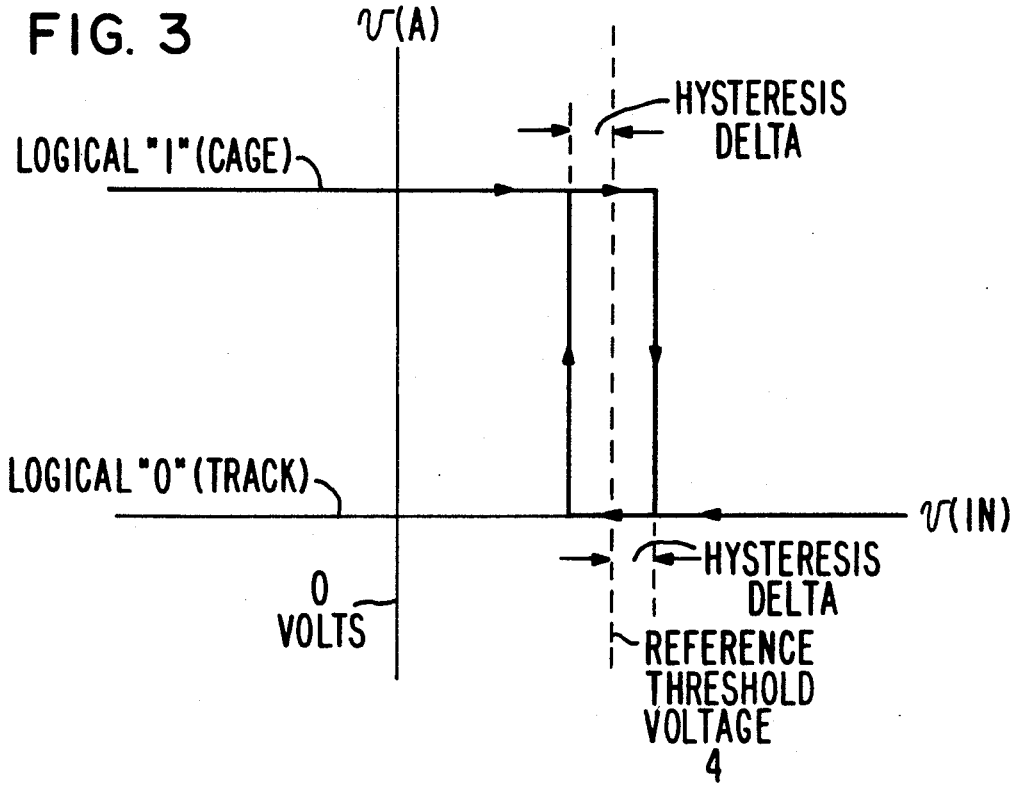
FIG. 3 illustrates the hysteresis conditioning of op amp 52 of FIG. 2.

Resistors 46, 48 and 50 constitute a hysteresis conditioning loop to attenuate the effects of noise-induced Jitter at the inverting input of op amp 52. This part of circuit 1 is illustrated in FIG. 3. v(in) is the voltage at the inverting input terminal of op amp 52, and v(A) is the voltage at point A, the output of op amp 52. In the illustrated embodiment, the reference threshold 4 has been set at 0.7 volts, and the hysteresis delta is 0.1 volt. Thus, if v(in) approaches the 0.7 volt threshold from the low voltage direction, v(in) must reach 0.8 volts rather than 0.7 volts to trigger a track signal (logical 0) at the output of op amp 52. If, on the other hand, v(in) approaches the 0.7 volt threshold from the high voltage direction, v(in) must reach .6 volts rather than 0.7 volts for a cage signal (logical 1) to be outputted by op amp 52.

Op amps 64 and 72, resistors 56, 58, 70, 74, and 76, diodes 60 and 68, and capacitor 62 constitute the time latch delay circuitry, i.e., one-shot 8 and OR-gate 10 of FIG. 1.

Op amp 64 is configured so that its threshold value for a logical 1 output is less than the 12 volt output of op amp 52, to allow for the contingency that the output of op amp 52 might not in an actual circuit reach a full 12 volts. Thus, in this example the threshold for op amp 64 has arbitrarily been chosen to be 8 volts. This is accomplished by means of the voltage divider comprising resistors 74 and 76, which places 8 volts at the non-inverting input of buffer op amp 72. This voltage is reflected to the output of op amp 72, then placed at the inverting input terminal of op amp 64. Resistor 70 is an input resistor to balance any offset voltages in op amp 64. Clamping diode 68 prevents the output voltage v(C) of op amp 64 from becoming negative. Thus, the output of op amp 64 is 12 volts for a logical 1, indicating cage, and 0 volts for a logical 0, indicating track. Resistor 66 provides some hysteresis conditioning for op amp 64, but since at this point of circuit 1 noise should no longer be much of a problem, the hysteresis delta provided by resistor 66 is only about 10 millivolts.

Figure 4:
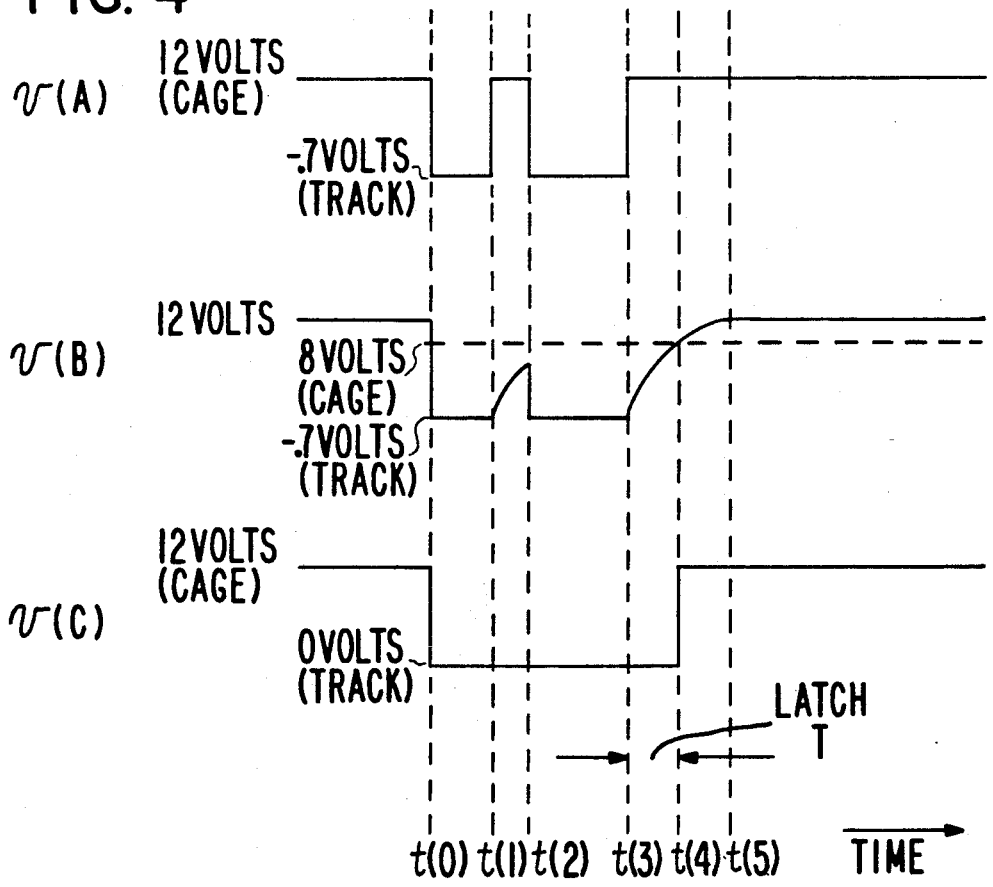
FIG. 4 is a timing diagram illustrating voltage waveforms at points A, B, and C of FIG. 2 for a hypothetical missile carrier signal 3.

FIG. 4 will now be described, bearing in mind that the notation v(N) means the voltage at point N, where N=A, B, or C. When activation circuit 1 is preinitialized, i.e., by the operator opening switch 16, it is assumed that the gyroscope is caged. Thus, v(A) is a logical 1, i.e., 12 volts. It is assumed that v(0) remains a logical 1 0 until time t(0), whereupon v(A) drops to a logical 0 (−0.7 volts), indicating track, until t(1). This rapid voltage drop is immediately passed through resistor 56 and diode 60 to point B, the non-inverting input terminal of op amp 64. This forces v(C) to be zero, also indicating track. Between t(1) and t(2), it is assumed that v(A) returns to a logical 1. For this voltage increase, however, the back biasing of diode 60 forces the current to flow through the slow loop having the relatively large valued resistor 58. v(B) begins to rise exponentially as capacitor 62 charges. However, the time between t(1) and t(2) is not long enough for v(B) to reach the 8 volt threshold of op amp 64, and thus v(C) remains at 0 volts. Between t(2) and t(3), it is assumed that v(A) reverts back to a logical 0. Once again, v(B) immediately drops to a logical 0 and v(C) remains at a logical 0. It is assumed that starting at t(3), v(A) reverts to a logical 1 for a time greater than the latch time T. After time T, v(B) reaches the 8 volt threshold of op amp 64 and at this time v(C) becomes a logical 1. At t(4), T has been reached. At t(5), capacitor 62 is fully charged.

Chip 80 corresponds to OR-gate 14 and inverter 12. It inverts the logic back to that used in FIG. 1, i.e., at output pin 3 of device 80, where 12 volts is a logical 1 and 0 volts is a logical 0, a logical 1 indicates track and a logical 0 indicates cage. The output of device 80 is coupled to the missile's caging and tracking means at output port 7, in parallel with operator switch 16. The operator's opening of switch 16 causes circuit 1 to preinitialize. As stated earlier, this can be done before entering combat, a big advantage over prior art systems. When umbilical line 15 is severed during launch, switch 16 is opened permanently, preventing the operator from subsequently caging the gyro.

Device 78 acts as an inverter so that a logical 1 (12 volts) at output pin 5 of device 78 indicates cage, while a logical 0 (−0 volts) at output pin 5 of device 78 indicates track. This signal is fed to telemetry on board the missile, via the voltage divider comprising equal resistances 82 and 84, at terminal 9. In the embodiment illustrated, this output to the telemetry is used only during developmental testing of the missile for purposes of monitoring the performance of circuit 1, since the telemetry on board the missile is replaced by a warhead for a fully operational missile. The reason for inserting voltage divider 82, 84 is to avoid the use of 0 volts to indicate information, because of the inability to distinguish between 0 volt information and a possibly inadvertent open circuit. Thus, voltage divider 82, 84 translates 0 volts at output pin 5 of device 78 to 6 volts at terminal 9, while passing through without modification a 12 volt signal between these two points.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. In a missile adapted for tracking a target and having two modes of operation, a tracking mode in which the missile is tracking the target and a non-tracking mode in which the missile is not tracking the target, apparatus for automatically transitioning from the non-tracking mode to the tracking mode, said apparatus comprising:

situated on board the missile, means for tracking the target;

means for measuring target quality, said measuring means producing a signal of a first type when the target is of sufficient quality to be tracked by the tracking means and a signal of a second type when the target is not of sufficient quality to be tracked by the tracking means; and coupled to the tracking means and to the measuring means, electronic means for automatically activating the tracking means in response to a signal from the measuring means indicating that the target is of sufficient quality to be tracked by the tracking means.

2. The apparatus of claim 1 wherein the tracking means comprises a gyroscope, the gyroscope being caged during the non-tracking mode and uncaged during the tracking mode.

3. The apparatus of claim 1 wherein, prior to its launch, the missile is mounted on a launch rail with an electrical connection bridging a portion of the electronic activating means associated with the launch rail and a portion of the electronic activating means situated on board the missile; wherein the launch of the missile severs the electrical connection, causing the missile to remain in the tracking mode despite the production of any subsequent signal from the measuring means indicating that the target is not of sufficient quality to be tracked by the tracking means.

4. The apparatus of claim 3 further comprising a switch, associated with the launch rail side of the rail/-missile interface and coupled to the electrical connection, for enabling an operator of the missile to preinitialize the electronic activating means, wherein the severing of the electrical connection prevents the operator from disabling the electronic activating means after the missile has been launched.

5. The apparatus of claim 1 wherein the electronic activating means comprises a time latch having a preselected delay interval during which the activating means continues to command the tracking means to remain activated despite the production of any signal from the measuring means indicating that the target is not of sufficient quality to be tracked by the tracking means.

6. The apparatus of claim 1 wherein the electronic activating means comprises a comparator having a first input coupled to receive the signals produced by the measuring means, and having a second input coupled to a preselected reference voltage, said comparator being hysteresis conditioned to minimize jitter induced by noise on said signals.

* * * * *